US005404070A

United States Patent [19]

Tsai et al.

[11] Patent Number: 5,404,070

[45] Date of Patent: Apr. 4, 1995

[54] LOW CAPACITANCE FIELD EMISSION DISPLAY BY GATE-CATHODE DIELECTRIC

[75] Inventors: Chun-hui Tsai, Hsin Chu; Jammy C. Huang, Taipei, both of Taiwan, Prov. of China

[73] Assignee: Industrial Technology Research Institute, Hsinchu, Taiwan, Prov. of China

[21] Appl. No.: 130,867

[22] Filed: Oct. 4, 1993

[51] Int. Cl.[6] ..... H01J 29/70

[52] U.S. Cl. ..... 313/336; 313/309

[58] Field of Search ..... 313/309, 336, 351, 355, 313/497, 574, 634; 445/24, 50; 345/74

[56] References Cited

U.S. PATENT DOCUMENTS

| | | | |
|---|---|---|---|
| 3,755,704 | 8/1973 | Spindt et al. | 313/336 |
| 4,763,187 | 8/1988 | Biberian | 313/309 |
| 4,857,161 | 8/1989 | Borel et al. | 204/192.2 |
| 4,874,981 | 10/1989 | Spindt | 313/309 |
| 4,884,010 | 11/1989 | Biberian | 313/309 |
| 4,908,539 | 3/1990 | Meyer | 313/309 |
| 5,075,591 | 12/1991 | Holmberg | 313/495 |
| 5,103,144 | 4/1992 | Dunham | 313/336 |
| 5,103,145 | 4/1992 | Doran | 313/336 |
| 5,141,459 | 8/1992 | Zimmerman | 313/336 |
| 5,151,061 | 9/1992 | Sandhu | 313/309 |

*Primary Examiner*—Stephen Brinich

*Attorney, Agent, or Firm*—George O. Saile; Stephen B. Ackerman

[57] ABSTRACT

A method for making a matrix addressed flat panel display using field emission microtips having reduced capacitance and low power consumption, and the resulting display, are described. A dielectric base substrate on which to form the field emission microtips is provided. Cathode columns of parallel spaced conductors are formed upon the substrate. First dielectric supports are formed in and above spaces between the cathode columns. Gate lines for the display are formed of parallel spaced conductors over the supports and perpendicular to the supports and the cathode columns. Second dielectric supports are formed below spaces between the gate lines, on the cathode columns and intersecting with the first supports. Pixels of the display are formed at the intersections of the cathode columns and the gate lines. There are a plurality of openings in the gate lines, at the pixels. A plurality of field emission microtips are formed at each of the pixels, connected to and extending up from the cathode columns and into the plurality of openings.

25 Claims, 9 Drawing Sheets

LOW CAPACITANCE FIELD EMISSION DISPLAY BY GATE-CATHODE DIELECTRIC

BACKGROUND OF THE INVENTION (1) Field of the Invention

The invention relates to field emission flat panel displays, and more particularly to methods for making a matrix addressed flat panel display having reduced capacitance and low power consumption, and the resulting display.

(2) Description of the Related Art

Field emission devices have been the subject of increased and renewed attention in recent years, as integrated circuit manufacturing techniques have allowed for miniaturization and new applications. Typically, one or many of a small, conical conductive emitter tip are formed on a conductive cathode. A second conductive surface is formed in close proximity and parallel to the cathode surface, with the two surfaces separated by a dielectric layer. Apertures are formed in the second surface and dielectric in the area of the emitter tips, with the opening in the second surface surrounding the upper part of the emitter. When a positive bias is applied at the second surface with respect to the cathode, electrons are emitted from the small emitter tip, with the current generated depending on the operating voltage, the sharpness of the tip and the emitter material work function.

One application for field emission devices is in the area of video displays, where there is an increasing need for flat, thin, lightweight displays to replace the traditional cathode ray tube (CRT) device. One of several technologies that provide this capability is field emission displays (FED). One such display is described in U.S. Pat. No. 4,857,161 by Borel et al. An array of very small, conical emitters is manufactured, typically on a semiconductor or glass substrate, and can be addressed via a matrix of columns and lines. These emitters are connected to parallel, conductive strips that form the cathode, and are surrounded at the tip by apertures in parallel conductive strips running perpendicular to the cathode strips, referred to as the gate. When the gate is positively biased with respect to the cathode at a particular emitter, by separate addressing means, electrons are emitted from the emitter tips at that location and attracted to an anode. The anode is typically mounted in close proximity to the cathode/gate/emitter structure and the area in between is evacuated. On the anode is cathodoluminescent material that emits light when excited by the emitted electrons, thus providing a display element.

One of the requirements for a video display is the need to provide a stable image, which in a CRT or a field emission display is accomplished by continual refreshing of the display elements, at a rapid speed. To sustain this speed the device must have a sufficiently low RC time constant, dependent on the resistance R and capacitance C of the display device elements. A lower capacitance could thus allow for a faster refresh and is desirable. And since power consumption in the display is also dependent in part on capacitance, lowering the capacitance can result in reduced power, which can be important in such applications as portable personal computers or other portable devices.

The problem and one solution to reducing the capacitance of a display using field emitters is discussed in U.S. Pat. No. 5,075,591 by Holmberg. It is noted that one means of reducing the capacitance is to increase the thickness of the dielectric layer between the cathode and gate. However, using the typical emitter formation process and a thicker dielectric will consume much more evaporated tip material and would place the emitter tip too far below the gate aperture. Holmberg describes a structure in which there is a sufficiently thin dielectric in the direct vicinity of the emitter tips, and a thicker dielectric in all other areas, thus reducing the overall capacitance of the display. However, this requires increased complexity in the manufacturing process.

SUMMARY OF THE INVENTION

It is therefore an object of this invention to provide a matrix addressed flat panel display having reduced capacitance and lower power consumption using field emission microtips.

This object is achieved by providing a dielectric base substrate on which to form the field emission microtips. Cathode columns of parallel spaced conductors are formed upon the substrate. First dielectric supports are formed in and above spaces between the cathode columns. Gate lines for the display are formed of parallel spaced conductors over the supports and perpendicular to the supports and the cathode columns. Second dielectric supports are formed below spaces between the gate lines, on the cathode columns and intersecting with the first supports. Pixels of the display are formed at the intersections of the cathode columns and the gate lines. There are a plurality of openings in the gate lines, at the pixels. A plurality of field emission microtips are formed at each of the pixels, connected to and extending up from the cathode columns and into the plurality of openings.

It is a further object of this invention to provide a very manufacturable method for fabricating a matrix addressed flat panel display having reduced capacitance and lower power consumption using field emission microtips.

This object is achieved by first providing a dielectric base substrate. Parallel spaced conductors are formed on the substrate, and act as the cathode columns for the display. A dielectric layer is formed over the cathode columns and the substrate. Parallel spaced conductors, acting as gate lines for the display, are formed over the dielectric layer and perpendicular to the cathode columns, the intersections of the cathode columns and gate lines being pixels of the display. A plurality of openings are formed in the gate lines, at the pixel locations. The dielectric layer is etched at the pixels, to form dielectric supports in and above spaces between the cathode columns, and below spaces between the gate lines. A plurality of field emission microtips is formed at each of the pixels and are connected to and extend up from the cathode conductor columns, into the plurality of openings.

DESCRIPTION OF THE PREFERRED EMBODIMENTS

Figure 1:
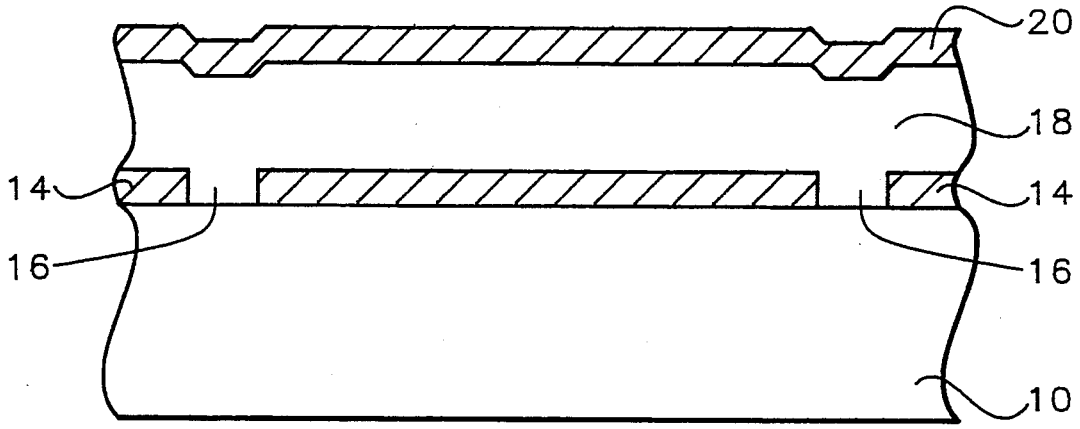
FIGS. 1, 2, 3, 4, 5 and 6 are a cross-sectional representation of the first embodiment of the invention, showing a method and structure for fabricating a flat panel display with field emission microtips, providing reduced capacitance and lower power consumption.

Referring now to FIGS. 1 through 8 the first embodiment is described. A dielectric substrate 10 is chosen. The substrate is typically glass, silicon wafer, or the like. If glass, it is preferred to use Corning 7740 or 7059. Depending upon the type of substrate used it may be preferred to use a dielectric layer (not shown) over the surface of the substrate 10. Such a layer may be, for example, aluminum oxide ($Al_2O_3$) or silicon dioxide ($SiO_2$) which would be deposited or thermally grown (in the case of $SiO_2$) by conventional integrated circuit processes and have a thickness of between about 1000 and 10,000 Angstroms. Usually this layer is used to obtain good adhesion for subsequent layers. When a silicon substrate is used for substrate 10, a thermally grown oxide is preferred for the dielectric layer. If a glass substrate 10 is used, then a deposited $SiO_2$ or $Al_2O_3$ is preferred. A conductive layer 14 composed of molybdenum, aluminum, tungsten, etc, or doped polysilicon is deposited by sputtering, electron beam evaporation or chemical vapor deposition (CVD) and has a thickness of between about 2000 and 5000 Angstroms, and forms the cathode element of the display. The layer 14 is patterned by conventional lithography and etching techniques into parallel, spaced conductors 14 acting as cathode columns. The space 16 between conductors is typically between about 10 and 20 micrometers.

A dielectric layer 18 is formed over cathode columns 14. This layer is preferably silicon oxide (SiO), but can alternatively be silicon nitride ($Si_3N_4$). This layer is deposited by chemical vapor deposition (CVD), sputtering or evaporation, to a thickness of between about 10,000 and 15,000 Angstroms. A conductive layer 20 is deposited over dielectric layer 18 and is preferably a metal such as molybdenum (Mo), aluminum (Al), tungsten (W), tantalum (Ta), etc, but can also be doped polysilicon. This layer is deposited by sputtering, evaporation or CVD, to a thickness of between about 2000 and 5000 Angstroms. This layer forms the gate of the field emission display and is patterned to form parallel, spaced strips that run perpendicular to the cathode columns 14.

At each location where a cathode column and gate line intersect is a pixel for the display. A pixel, or picture element, corresponds to one display point on the opposing glass plate where electrons from the pixel's emitter tips strike a light-emitting phosphor.

Figure 2:
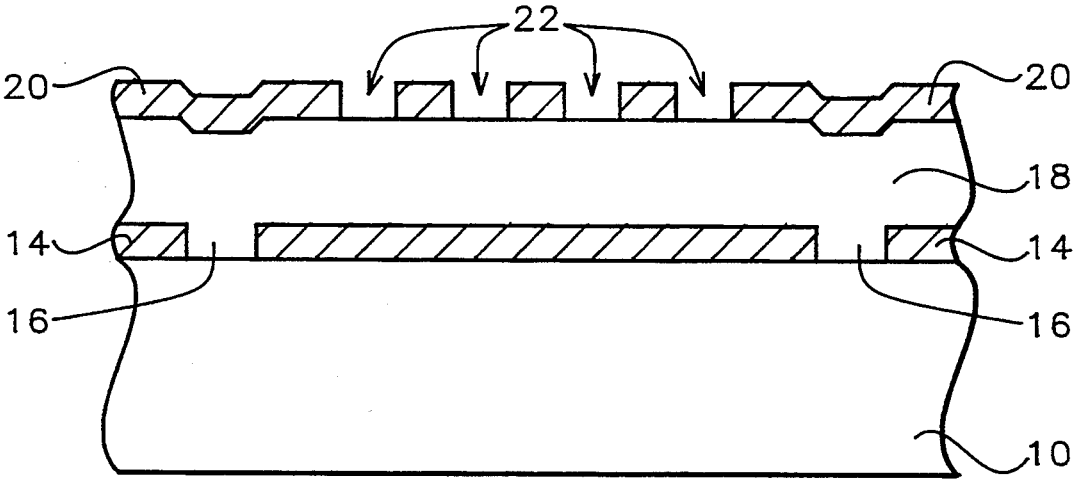

Referring now to FIG. 2, gate openings 22 are formed in gate layer 20 and are typically circular apertures formed by etching the gate at each location where a field emitter is desired to be located. Each opening 22 has a diameter of about one micrometer.

Figure 3:
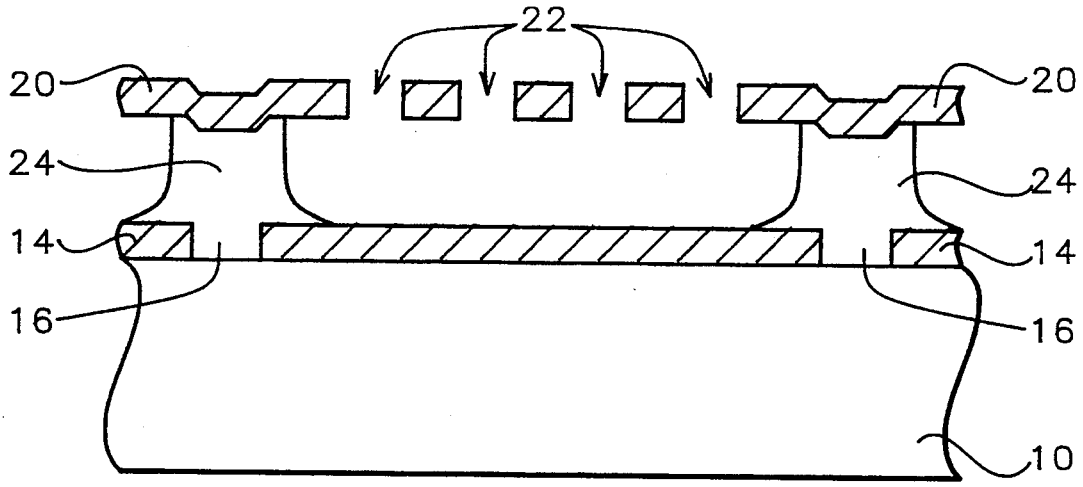

In FIG. 3, the critical step of the invention is shown. Layer 18 is removed by a wet etch in all but the areas of dielectric supports 24. The etchant used depends on the material used for dielectric layer 18. For instance, the use of silicon dioxide ($SiO_2$) as the dielectric would require an etch using buffered hydrofluoric (HF) acid. Similarly, the use of silicon nitride ($Si_3N_4$) would require an etch using phosphoric acid. The supports 24 serve the purposes of supporting the gate lines and preventing electrical shorts between the gate and cathode lines.

Figure 4:
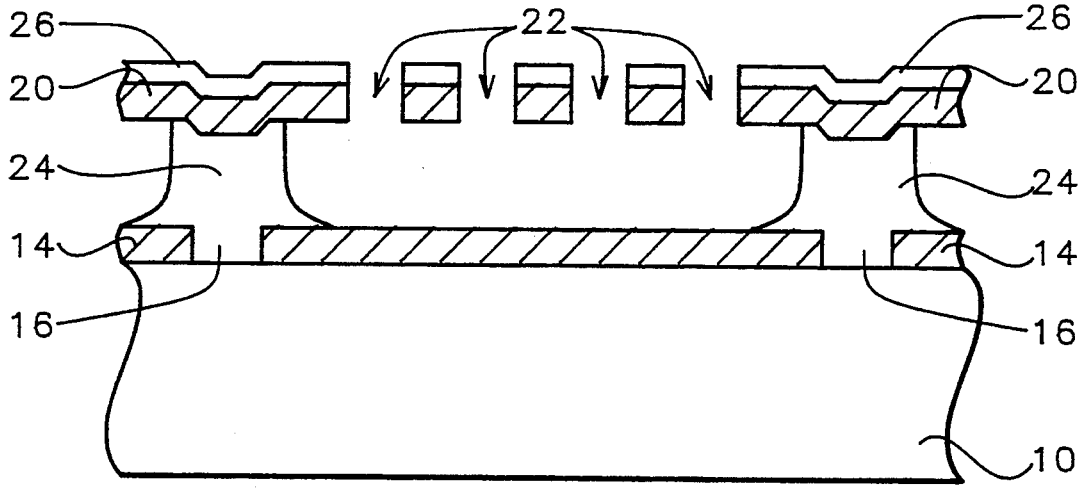
Figure 5:
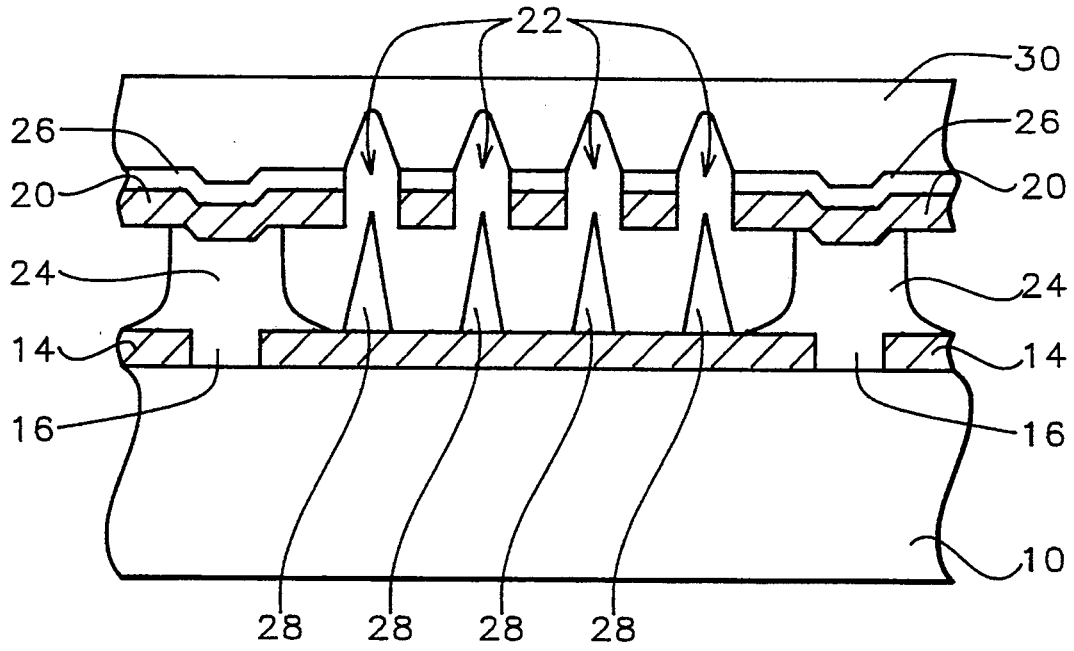

Referring now to FIG. 4, there is shown the method used to form the field emission microtips. A sacrificial layer 26 of, preferably, nickel (Ni), and alternatively, a multilayer structure such as silicon nitride ($Si_3N_4$) and silicon dioxide ($SiO_2$), is deposited by e-beam evaporation using graze angle deposition (to prevent filling of openings 22) by tilting the wafer at an angle of 75°, or for the alternative multilayer structure, by CVD method. The thickness of this layer, or layers, is between about 1000 and 2000 Angstroms. In FIG. 5, a layer of, for instance, molybdenum, is deposited vertically to a thickness of between about 15,000 and 20,000 Angstroms, thus forming field emission microtips 28 which are connected to cathode conductor 14 and have a height of between about 10,000 and 15,000 Angstroms. Also formed is excess layer 30.

Figure 6:
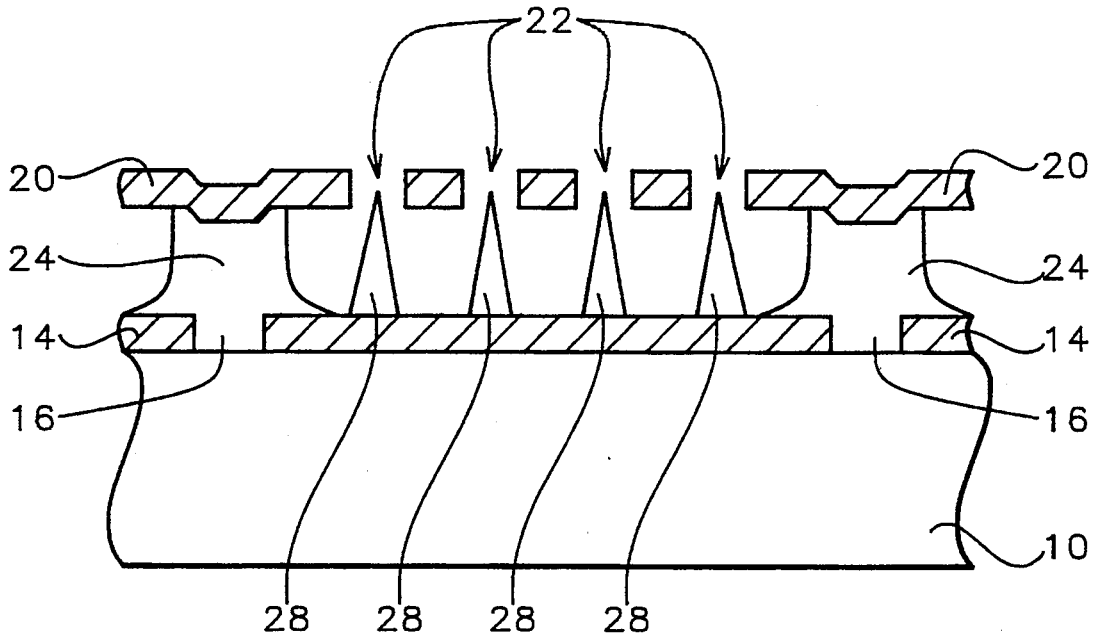

Referring now to FIG. 6, excess layer 30 is removed by dissolving lift-off layer 26 by wet etch, using the etchants as shown in "Thin Film Process", J. L. Vossen and W. Kern, Academic Press, New York (1978), p. 470. This etch also removes layer 26, resulting in the final structure shown in FIG. 6.

Figure 3A:
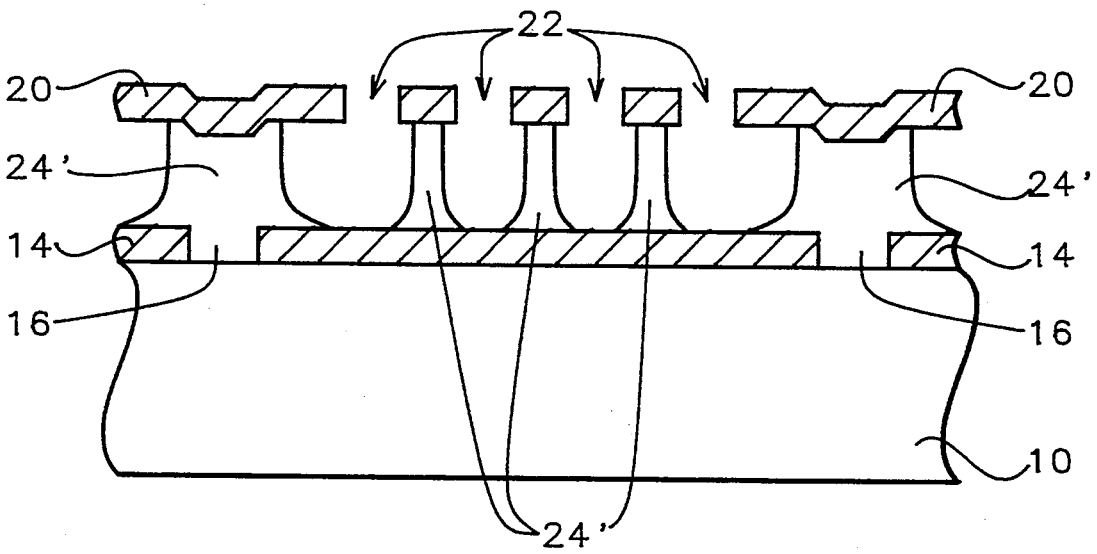
FIGS. 3*a*, 4*a* and 5*a* are a cross-sectional representation of the first embodiment of the invention, showing a second method for fabricating a flat panel display with field emission microtips, providing reduced capacitance and lower power consumption.
Figure 4A:
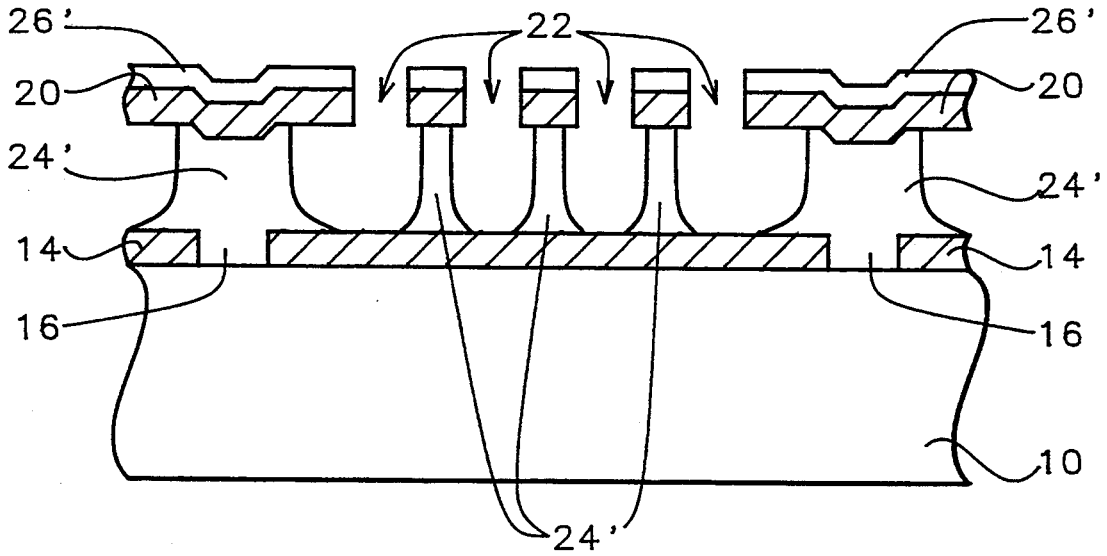
Figure 5A:
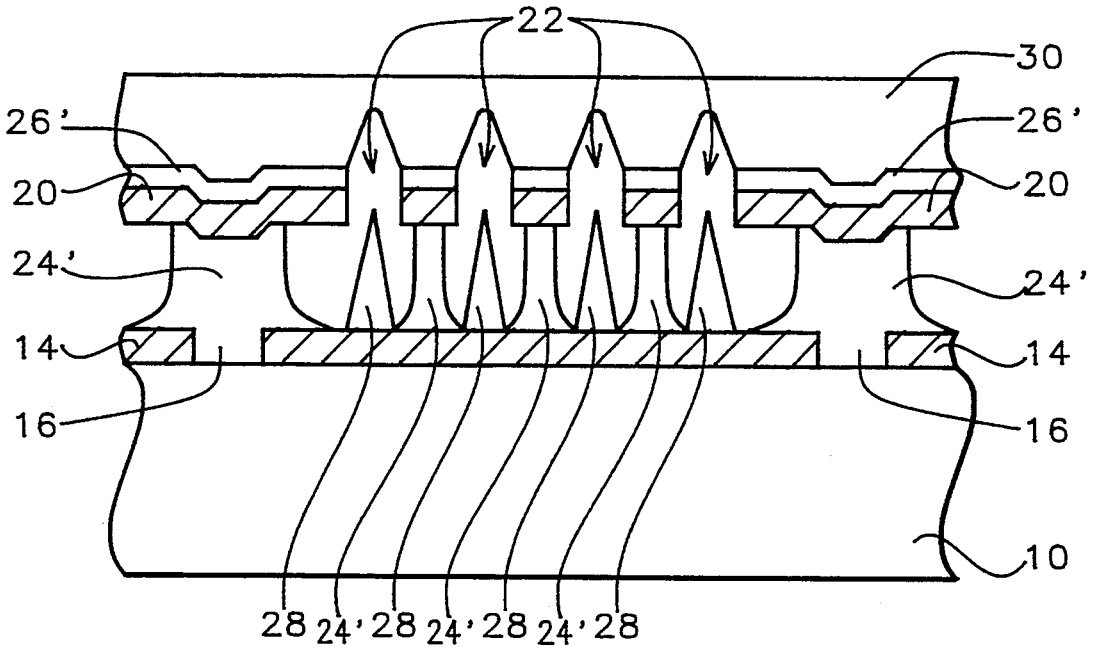

A second method for forming the FIG. 6 structure is shown in FIGS. 3*a*, 4*a* and 5*a*. The method is the same as in the first method above up to the structure of FIG. 2. As shown in FIG. 3*a*, layer 18 is etched to form tip holes 25 through gate openings 22 to the top of layer 14. The dielectric layer 18 between adjacent gate openings remains to form supports 24', which prevents the deformation of conductive layer 20 during subsequent process steps.

Referring now to FIG. 4*a*, a sacrificial layer 26' is deposited using the same process and conditions as described above for FIG. 4. However, in this second method, the material for layer 26' is chosen to have similar chemical properties as the dielectric layer 18 material such that the same etchant would etch both materials. In FIG. 5*a*, layer 30 is deposited vertically and is the of same material as in the first method above, and its deposition also forms emitters 28. Excess layer 30 is then removed by dissolving sacrificial layer 26'. Due to the similar properties of layers 18 and 26', the dielectric supports 24' between adjacent gate openings are removed at the same time as sacrificial layer 26'. However, the dielectric supports 24' above the space 16 between conductors 14 remain, resulting in the FIG. 6 structure.

Figure 7:
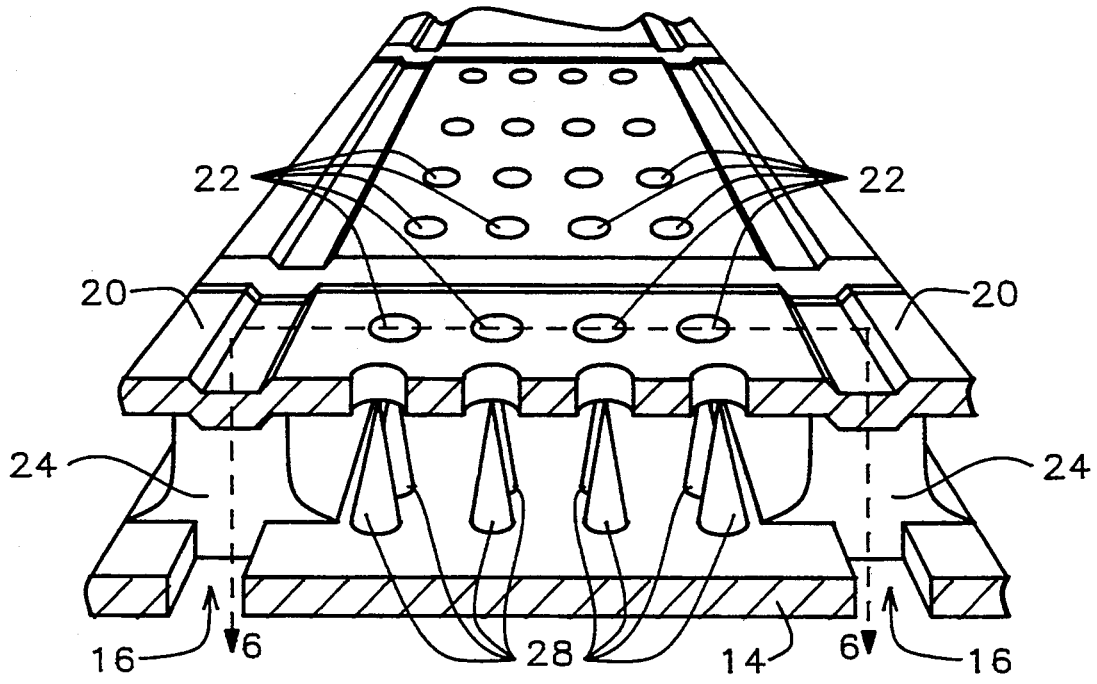
FIG. 7 is a three-dimensional view of the resulting structure of the first embodiment.

A three-dimensional view of this structure is shown in FIG. 7. The same reference numbers are used to refer to the elements as in previous figures, and the FIG. 6 cross-sectional view is indicated by line 6—6 in FIG. 7. Although an array of 4×4 emitters is shown in each pixel in this figure, any number of emitters could be used, depending on the amount of redundancy desired, from a single emitter to several thousand emitters.

As can be seen in both FIG. 6 and 7, there is no dielectric in the regions between the emitters within each pixel. This has the effect of lowering the capacitance to approximately $\frac{1}{4}$ of its original value. This can be understood by the equation for capacitance C, $$C=eA/d$$

where e is the dielectric constant, A is the area of the capacitor plates (here, the cathode and gate), and d is the distance between the plates. While removing the dielectric does not change A or d, the dielectric constant for a vacuum is about $\frac{1}{4}$ that of silicon dioxide ($SiO_2$), i.e., given a dielectric value of a vacuum of 1, $SiO_2$ has a relative dielectric constant of 3.9. When the material dielectric material is silicon nitride ($Si_3N_4$), the capacitance using the method of the invention is reduced to about $\frac{1}{8}$ of its original value, since $Si_3N_4$ has a relative dielectric constant of 8. Since the resistance R stays the same as in the prior art structure, it can be seen that a reduction to $\frac{1}{4}$ of the original capacitance C leads to a corresponding reduction in the RC time constant of $\frac{1}{4}$ of the original time constant.

Figure 8:
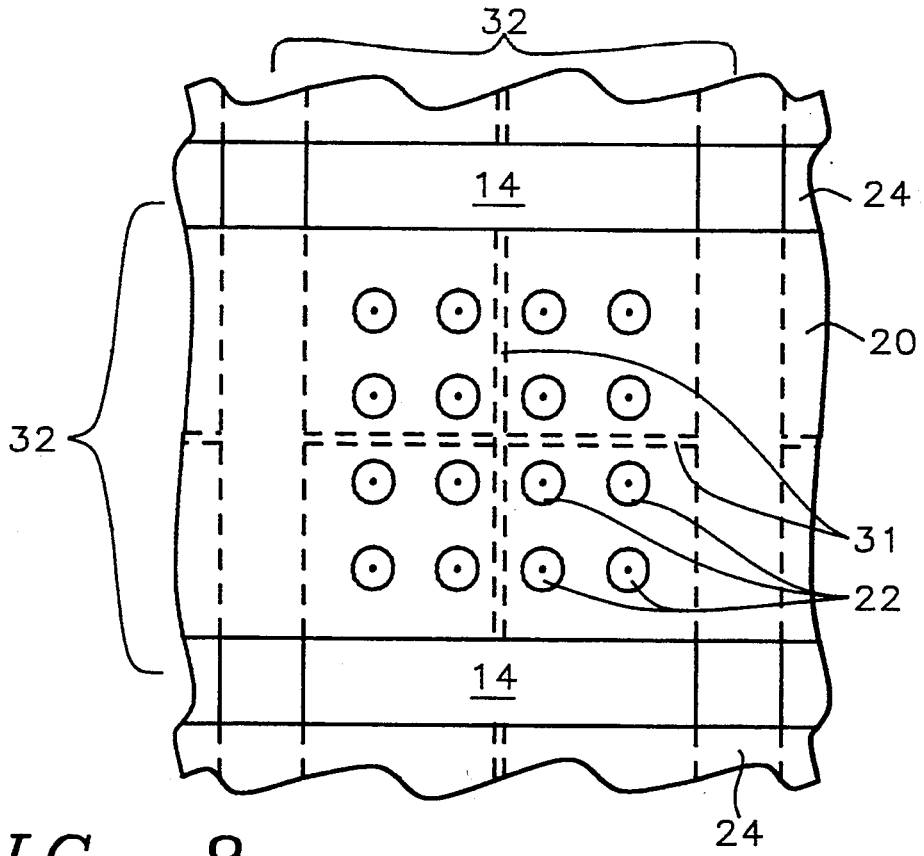
FIGS. 8 and 8*a* are top views of the resulting structure of the first embodiment.
Figure 8A:
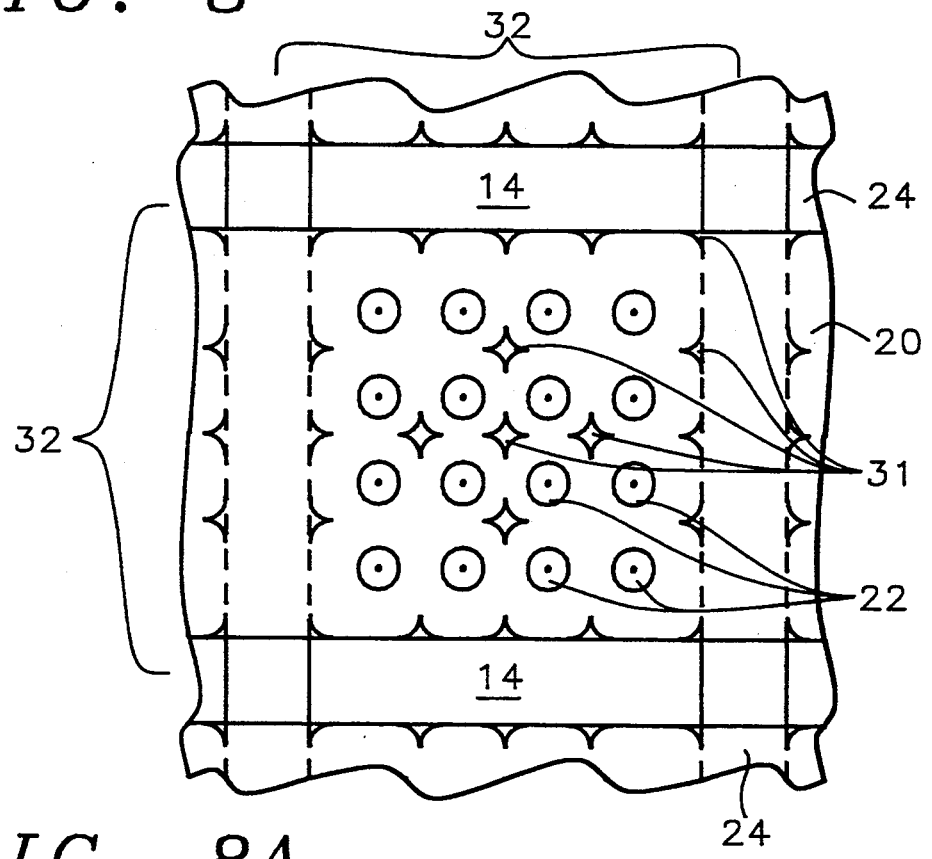

FIGS. 8 and 8*a* are a top-view of a pixel for the field emission display of the invention. Enhancement supports 31 are shown. These supports can be formed by layout and process technology, and can be in the shape of crossed lines as shown in FIG. 8, or a points shape as shown in FIG. 8*a*. There are also larger dielectric supports 24 at the border of each pixel, with the pixel defined by sides 32. The number of supports can be varied as desired to provide the needed support for layer 20, and thus is not limited to the number shown in the figure. Any number of emitters could be used between each set of enhancement supports, depending on the amount of redundancy desired, from a two emitters to 10,000 emitters.

Figure 9:
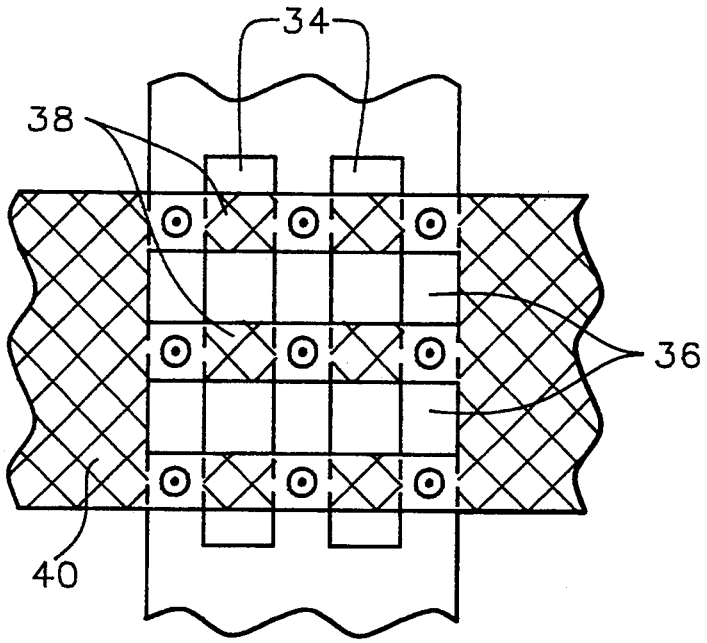
FIG. 9 is a top view of the resulting structure of a second embodiment of the invention for a flat panel display with field emission microtips and further reduced capacitance.
Figure 10:
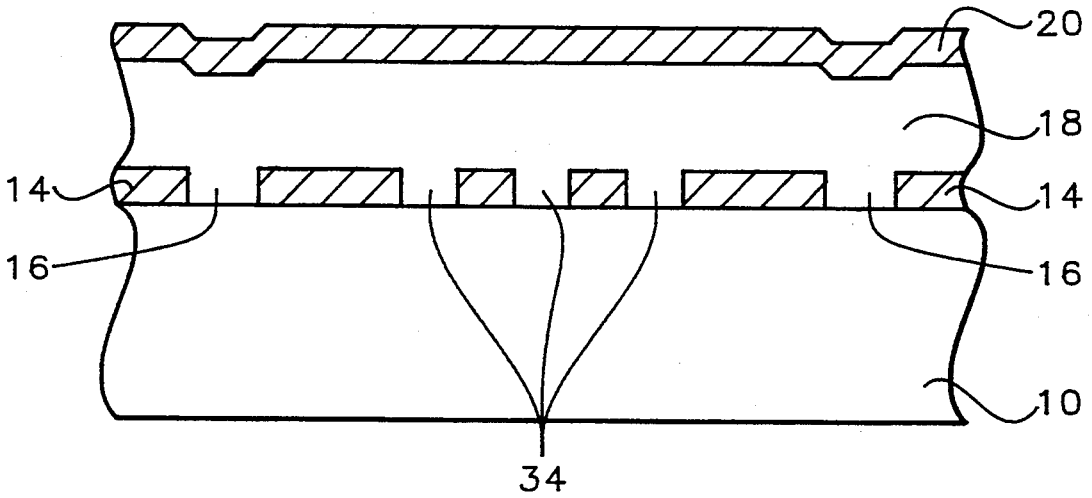
FIGS. 10 to 13 are a cross-sectional representation of the second embodiment method of the invention for fabricating the field emission display with further reduced capacitance.

The second embodiment of the invention can be understood with reference to FIGS. 9 through 14. A top view is shown in FIG. 9, in which cut-out areas 34 are formed in the cathode in each pixel, and cut-out areas 36 are formed in the gate layer as well. Dielectric supports 38 are formed where there is a vertical intersection of cathode cut-out areas 34 and the gate layer 40. Although an array of 3×3 emitters is shown in FIG. 9, any number of emitters could be used, and the number of cut-out areas 34 and 36 could be varied as well.

Figure 11:
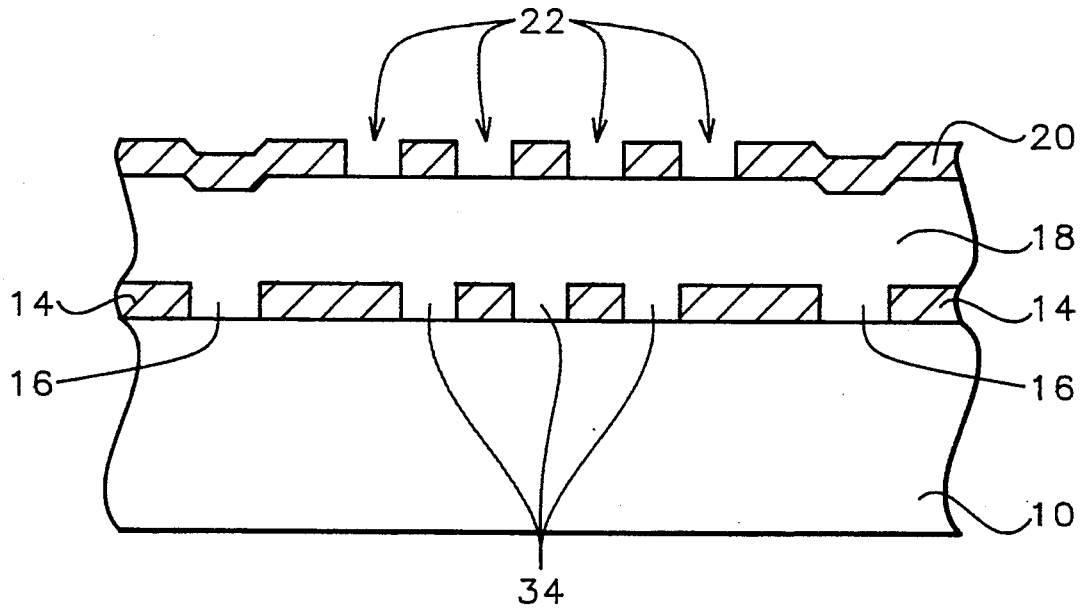

The method for forming the second embodiment structure is shown in FIGS. 10 through 13. The FIG. 10 structure is formed by the same method used in the first embodiment to arrive at the FIG. 1 apparatus, except that cathode cut-out areas 34 are formed in the same cathode patterning step as spaces 16 in the cathode. As shown in FIG. 11, gate openings 22 and the gate cut-out areas (not shown) are then formed in gate layer 20.

Figure 12:
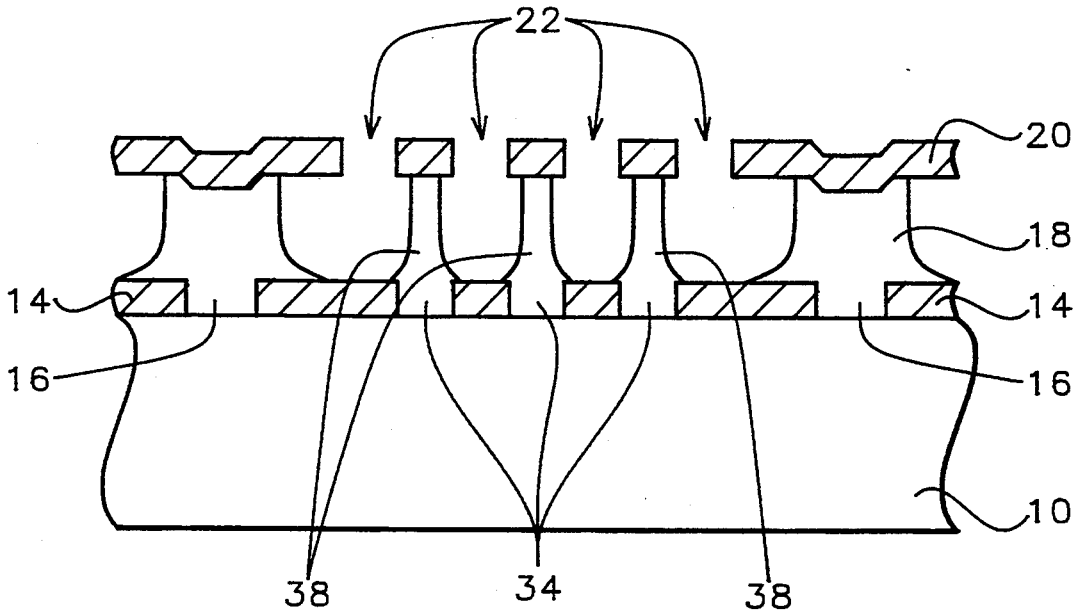
Figure 13:
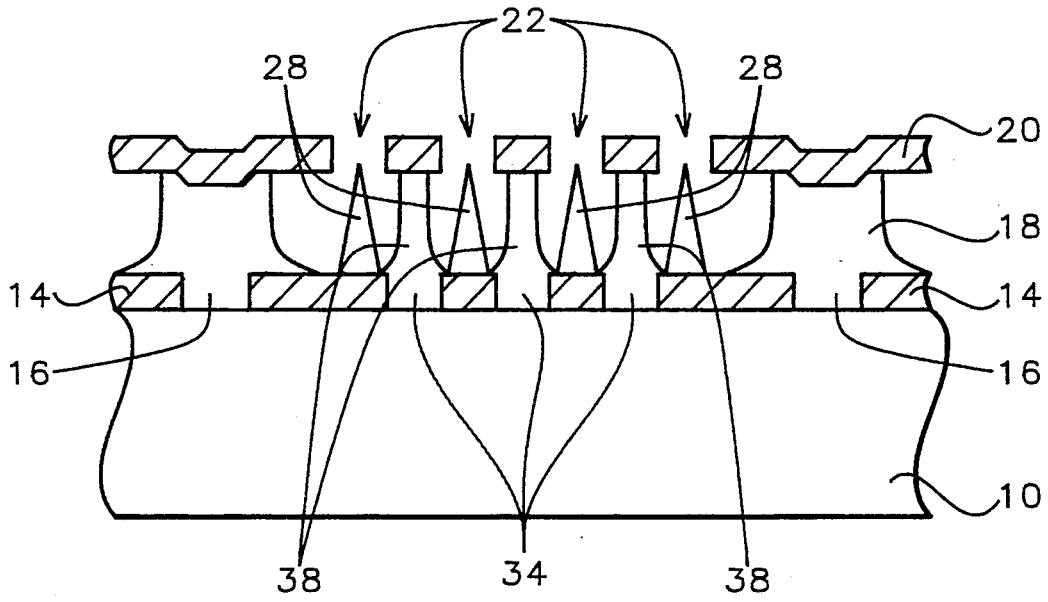

In FIG. 12, the critical step of the second embodiment is shown. Layer 18 is removed by a wet etch in all but the areas of dielectric supports 24, and the areas of dielectric supports 38 in the regions between emitters, and above cathode cut-out areas 34. The etchant used depends on the material used for dielectric layer 18, as in the first embodiment. The emitters 28 are then formed in the identical manner as in the first embodiment, to result in the final structure shown in FIG. 13.

Figure 14:
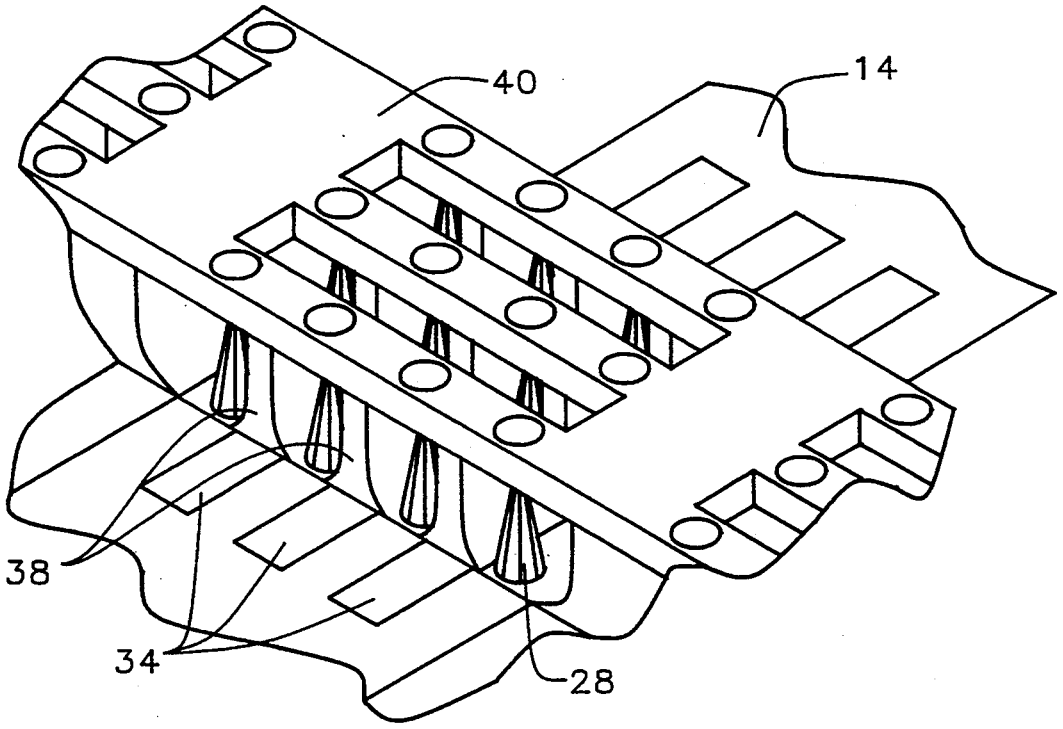
FIG. 14 is a three-dimensional view of the resulting structure of the second embodiment of the invention.

The resultant structure of the second embodiment is shown in the three-dimensional view of FIG. 14. It can be seen that dielectric supports 38 are formed in those regions under the gate 40 but within the cathode cutout areas 34. This has the effect of reducing the capacitor area to approximately $\frac{1}{4}$ of the original area, since there are two capacitive "plates" (opposing areas of the cathode and gate) only in those regions of the pixel in which an emitter is formed, which thus reduces the capacitance. The resulting capacitance is approximately 1/16 of the prior art structure. This is due to the product of the $\frac{1}{4}$ area reduction, and a $\frac{1}{4}$ reduction due to the lower dielectric constant of a vacuum as compared to silicon dioxide.

The field emitter structure of the second embodiment increases the resistance somewhat greater than four times, since the width of the gate line is reduced by more than $\frac{1}{2}$, and the cathode line is reduced by approximately $\frac{1}{2}$. Subsequently, there is no net benefit to the RC time constant. However, AC power consumption is reduced, since it is proportional to the decreased capacitance C but not to increased resistance R. However, DC power consumption is slightly increased due to the resistance increase.

The need for the reduced capacitance can perhaps best be understood by Tables I and II below, which shows an operational data and key measurements for a typical application using a prior art field emission display.

TABLE I

| Operational data for a 10" VGA (prior art) monitor |
|---|
| ∘ Pixels = 640 × 480 |
| ∘ Frame rate = 60 Hz |
| ∘ Scan and Data Frequency (f) = 29 kHz. |
| ∘ Period = 34 microseconds (usec) |
| ∘ Sheet resistance (for doped polysilicon in conductive layer) = ~11 ohms/square |
| ∘ Sheet resistance (for aluminum film in conductive layer) = ~0.055 ohms/square |
| ∘ Capacitance per pixel = ~3 picofarad (pf) (based on an area of 90000 sq. micrometers (um), and 1 um thickness) |
| ∘ Scan line voltage ($V_S$) = 20 volts |
| ∘ Data line voltage ($V_D$) = 20 volts |
| ∘ Cathode emission current for normal operation = 30 microamperes/cm.$^2$ (uA/cm.$^2$) |
| ∘ Scan-line resistance ($R_S$): |
| - for polysilicon = 11 ohms/square * 640 pixels/scan line = 7 kohm/scan line |
| - for aluminum = 0.055 ohms/square * 640 pixels/scan line = 35 ohm/scan line |
| ∘ Data line resistance ($R_D$): |
| - for polysilicon = 11 ohms/square * 480 pixels/scan line = 5.3 kohm/scan line |
| - for aluminum = 0.055 ohms/square * 480 pixels/scan line = 26 ohm/scan line |
| ∘ Scan line capacitance ($C_S$): 3 pf * 640 pixels/scan line = 1.92 nf/scan line |
| ∘ Data line capacitance ($C_D$): 3 pf * 480 pixels/data line = 1.44 nf/data line |
| ∘ Total emission current of entire panel: 30 uA/cm$^2$ * 300 cm$^2$ = 9 mA |

TABLE II

| Key measurements for a 10" VGA (prior art) monitor |
|---|
| ∘ RC time constant of scan line ($R_S$ * $C_S$): |
| - for polysilicon = 7 kohms * 1.92 nf = 14 usec |
| - for aluminum = 35 ohms * 1.92 nf = 0.07 usec |
| ∘ RC time constant of data line (($R_D$ * $C_D$): |
| - for polysilicon = 5.3 kohms * 1.92 nf = 10 usec |
| - for aluminum = 26 ohms * 1.92 nf = 0.05 usec |
| ∘ AC power dissipation - scan line operation (f*$C_S$*$V_S^2$): |

TABLE II-continued

| Key measurements for a 10" VGA (prior art) monitor | |
|---|---|
| | = 29 kHz * 1.92 nf * (20 v)$^2$ |
| | = 22 milliwatts (mW)/scan line |
| ∘ Total AC power dissipation for scan line operation: | |
| | = 22 mW/scan line * 480 scan lines |
| | = 10.6 W |
| ∘ AC power dissipation | - data line operation ($f*C_D*V_D^2$): |
| | = 29 kHz * 1.44 nf * (20 v)$^2$ |
| | = 17 mW/scan line |
| ∘ Total AC power dissipation for data line operation: | |
| | = 17 mW/data line * 640 data lines |
| | = 10.7 W |
| ∘ Total AC power dissipation for entire panel: | |
| | = 10.6 W + 10.7 W = 21.3 W |
| ∘ DC power dissipation ($I^2*R$): | |
| - scan lines = | DC power dissipation is negligible due to very low gate current |
| - data lines | |
| ∘ polysilicon = | (9 mA)$^2$ * 2.7 kohms = 220 mW |
| ∘ aluminum = | (9 mA)$^2$ * 14 ohms = 1 mW |
| - cathode-to-anode potential drop (anode voltage = 400 V) | = 9 mA * 400 V = 3.6 W |
| - Total DC power dissipation for entire panel: | |
| | = 0.22 W + .001 W + 3.6 W = 3.8 W |

The RC time constant and AC power using the prior art field emission device shown in the above two tables are too large for the example display. These figures are compared to the improved measurements for the two embodiments of the invention, in Table III below.

TABLE III

| | RC (usec) | | AC | |
|---|---|---|---|---|
| | poly-Si | Al | Power (W) | DC power (W) |
| prior art: | 14 | 0.07 | 21.3 | 3.8 |
| 1st embodiment: | 3.5 | 0.02 | 5.3 | 3.8 |
| 2nd embodiment: | * | * | 1.3 | 4.04 |

(* = between prior art and 1st embodiment amounts)

While the invention has been particularly shown and described with reference to the preferred embodiments thereof, it will be understood by those skilled in the art that various changes in form and details may be made without departing from the spirit and scope of the invention. For instance, the type of field emitter used is not limited to the microtip structure shown in the drawings, but could also include wedge-shaped emitters, which are well-known to those skilled in the art, or other microstructures that emit electrons under the influence of an electric field.

What is claimed is:

1. A matrix addressed flat panel display with field emission microtips and reduced capacitance, comprising:

a dielectric base substrate;

cathode columns for said display, formed of parallel spaced conductors upon said substrate;

first dielectric supports in and above spaces between said cathode columns;

gate lines for said display, formed of parallel spaced conductors, above and perpendicular to said first dielectric supports and said cathode columns;

second dielectric supports below spaces between said gate lines, formed on said cathode columns and intersecting with said first supports;

pixels of said display at the intersections of said cathode columns and said gate lines;

a plurality of openings in said gate lines, at each of said pixels; and a plurality of field emission microtips at each of said pixels, connected to and extending up from said cathode columns and into said plurality of openings.

2. The flat panel display of claim 1 further comprising enhancement supports between said gate lines and said cathode columns, within said pixels, parallel to said first and second dielectric supports.

3. The flat panel display of claim 2 wherein there are between about 2 and 10,000 of said field emission microtips between said enhancement supports.

4. The flat panel display of claim 1 wherein said microtips are conical.

5. The flat panel display of claim 1 wherein said microtips are wedge-shaped.

6. The flat panel display of claim 1 wherein said first and second dielectric supports are formed of a silicon oxide.

7. The flat panel display of claim 1 wherein said first and second dielectric supports are formed of silicon nitride.

8. A method of fabricating a matrix addressed flat panel display having cathode columns, gate lines and field emission microtips and reduced capacitance, comprising the steps of:

providing a dielectric base substrate;

forming parallel spaced conductors, acting as said cathode columns for said display, upon said substrate;

forming a dielectric layer over said cathode columns and said substrate;

forming parallel spaced conductors, acting as gate lines for said display, over said dielectric layer, and perpendicular to said cathode columns, the intersections of said cathode columns and gate lines being pixels of said display;

forming a plurality of openings in said gate lines, at each of said pixels;

forming dielectric supports, by etching said dielectric layer at said pixels, in and above spaces between said cathode columns, and below spaces between said gate lines; and forming at each of said pixels a plurality of field emission microtips connected to and extending up from said cathode conductor columns and into said plurality of openings.

9. The method of claim 8 wherein the step of forming a plurality of field emission microtips comprises the steps of:

forming a sacrificial layer on said gate layer;

forming said field emission microtips by vertical evaporation of a conductive material; and removing said sacrificial layer, and excess conductive material formed on said sacrificial layer during said forming of said field emission microtips.

10. The method of claim 9 wherein the steps of removing said sacrificial layer and etching said dielectric layer to form dielectric supporters, are accomplished simultaneously.

11. The step of claim 8 of forming dielectric supports further comprising forming enhancement supports in areas within said pixel region other than under said openings.

12. The method of claim 8 wherein said dielectric layer is a silicon oxide and said etching of said dielectric supports is a wet etch with buffered hydrofluoric acid.

13. The method of claim 8 wherein said dielectric layer is silicon nitride and said etching of said dielectric supports is a wet etch with phosphoric acid.

14. The method of claim 8 wherein the thickness of said dielectric layer is between about 10,000 and 15,000 Angstroms.

15. A matrix addressed flat panel display with field emission microtips and reduced capacitance, comprising:

a dielectric base substrate;

cathode columns for said display, formed of parallel, slotted, spaced conductors upon said substrate; gate lines for said display, formed of parallel, slotted, spaced conductors, over and perpendicular to said cathode columns;

pixels of said display at the intersections of said cathode columns and said gate lines;

a plurality of openings in said gate lines, at each of said pixels;

a plurality of field emission microtips at each of said pixels, connected to and extending up from said cathode columns and into said plurality of openings; and dielectric supports, formed on said substrate in slots of said cathode columns, between said field emitter microtips, and rising up to connect to said gate line between slots of said gate line.

16. The flat panel display of claim 15 wherein there are between about 2 and 10,000 of said field emission microtips at each of said pixels.

17. The flat panel display of claim 15 wherein said dielectric supports are formed of a silicon oxide.

18. The flat panel display of claim 15 wherein said dielectric supports are formed of silicon nitride.

19. A method of fabricating a matrix addressed flat panel display having cathode columns, gate lines and field emission microtips and reduced capacitance, comprising the steps of:

providing a dielectric base substrate; forming parallel, spaced, slotted conductors, acting as said cathode columns for said display, upon said substrate;

forming a dielectric layer over said cathode columns and said substrate;

forming parallel, spaced, slotted conductors, acting as gate lines for said display, over said dielectric layer, and perpendicular to said cathode columns, the intersections of said cathode columns and gate lines being pixels of said display;

forming a plurality of openings in said gate lines, at each of said pixels;

etching said dielectric layer at said pixels, to form dielectric supports in slots of said cathode columns, between said field emitter microtips, and rising up to connect to said gate line between slots of said gate line; and forming at each of said pixels a plurality of field emission microtips connected to and extending up from said cathode conductor columns and into said plurality of openings.

20. The method of claim 19 wherein the step of forming a plurality of field emission microtips comprises the steps of:

forming a sacrificial layer on said gate layer;

forming said field emission microtips by vertical evaporation of a conductive material; and removing said sacrificial layer, and excess conductive material formed on said sacrificial layer during said forming of said field emission microtips.

21. The method of claim 19 wherein said dielectric layer is a silicon oxide and said etching of said dielectric supports is a wet etch with buffered hydrofluoric acid.

22. The method of claim 19 wherein said dielectric layer is silicon nitride and said etching of said dielectric supports is a wet etch with phosphoric acid.

23. The method of claim 19 wherein the thickness of said dielectric layer is between about 10,000 and 15,000 Angstroms.

24. The method of claim 19 wherein said slots in said cathode columns are formed contiguously between said emitters running parallel to direction of said cathode columns.

25. The method of claim 19 wherein said slots in said gate lines are formed contiguously between said openings running parallel to direction of said gate lines.

* * * * *

UNITED STATES PATENT AND TRADEMARK OFFICE

CERTIFICATE OF CORRECTION

PATENT NO. : 5,404,070
APPLICATION NO. : 08/130867
DATED : April 4, 1995
INVENTOR(S) : Chun-hui Tsai et al.

It is certified that error appears in the above-identified patent and that said Letters Patent is hereby corrected as shown below:

In the title, page 1, after "DIELECTRIC" insert -- ELIMINATION --, therefor.

In column 1, line 2, after "DIELECTRIC" insert -- ELIMINATION --, therefor.

Signed and Sealed this

Tenth Day of November, 2009

David J. Kappos

David J. Kappos
*Director of the United States Patent and Trademark Office*